United States Patent [19]

Endo

[11] 4,357,098

[45] Nov. 2, 1982

[54] ELECTROSTATIC RECORDING APPARATUS

[75] Inventor: Koichi Endo, Hachioji, Japan

[73] Assignee: Konishiroku Photo Industry Co., Ltd., Tokyo, Japan

[21] Appl. No.: 193,885

[22] Filed: Oct. 3, 1980

[30] Foreign Application Priority Data

Oct. 9, 1979 [JP] Japan ..... 54/130429

[51] Int. Cl.[3] ..... G03G 21/00

[52] U.S. Cl. ..... 355/15; 15/256.51

[58] Field of Search ..... 355/15, 3 R; 15/1.5, 15/256.5, 256.51

[56] References Cited

U.S. PATENT DOCUMENTS

| | | | |
|---|---|---|---|
| 3,792,925 | 2/1974 | Milligan et al. | 355/15 |
| 4,025,180 | 5/1977 | Kurita et al. | 355/16 X |
| 4,131,359 | 12/1978 | Honda | 355/15 |
| 4,140,388 | 2/1979 | Ikesue | 355/15 |
| 4,158,498 | 6/1979 | Ohmori | 15/256.51 |
| 4,218,131 | 8/1980 | Ito et al. | 355/15 |
| 4,218,132 | 8/1980 | Iwai et al. | 355/15 |
| 4,278,345 | 7/1981 | Davis et al. | 355/15 |

*Primary Examiner*—Richard L. Moses
*Attorney, Agent, or Firm*—James E. Nilles

[57] ABSTRACT

An electrostatic recording apparatus comprising a cleaning device having a toner scraping member and a cleaning member. The cleaning device is movable between a position where a tip end of the toner scraping member is in contact with an image forming member and a position where the tip end of the toner scraping member is apart from the image forming member. The cleaning member is arranged on the moving path of the tip end for the toner scraping member. Toner attached on the tip end of the toner scraping member is removed when the tip end is contacted with and passed through the cleaning member.

4 Claims, 5 Drawing Figures

ELECTROSTATIC RECORDING APPARATUS

BACKGROUND OF THE INVENTION

1. Field of the Invention

The present invention relates to an electrostatic recording apparatus, such as an electrophotographic copying machine, more specifically relates to an electrostatic recording machine having an improved cleaning device.

2. Description of the Prior Art

In an electrostatic recording apparatus, such as a transfer type electrophotographic copying machine, an electrostatic latent image is produced on an image forming member by projecting a light on an original to be copied and projecting a reflex light reflexed from the original to be copied on the image forming member, a visible image or toner image is obtained by developing said electrostatic latent image by using a developing agent including toner, and a copied image of the original is produced on a transfer paper by transferring and fixing said visible image on the transfer paper. In an electrophotographic treating carried out in the copying machine of this type, toner remains on the image forming member even after the transfer treating has been carried out and accordingly the residual toner must be removed from the surface of the image forming member prior to the next electrophotographic treating in order to prevent the image from being spoiled due to the residual toner. A device to be used for this purpose is called as a cleaning device and many kinds of such cleaning devices, such as of the type using a toner scraping member or using a feather have been proposed.

The cleaning device of the type using the feather has such a drawback that not only toner is scattered from the cleaning device and darts the device when the cleaning is carried out, but also the scattered toner is attached again on the image forming member to cause the spoiled image. Accordingly, the cleaning device of the type using the toner scraping member (refer to as blade hereinafter) has been recommended to use.

FIG. 1 is a schematic view of a cleaning device A of the type using a blade 2. As will be appreciated from the description hereinbefore, an electrostatic latent image is changed to toner image by developing means (not shown) on a photosensitive layer 1*a* mounted on a photosensitive drum 1 which is being rotated in the counter-clockwise direction. Then the attached toner is transferred by transfer means (not shown) on a transfer paper. Some of toner is remained on the surface of the photosensitive layer 1*a* after toner has been transferred. This residual toner is scraped off by a tip end corner portion 3 of the cleaning blade 2 and the scraped toner is guided along a toner guide member 4 and collected in cleaning device A. In case that the copying operation is carried out by using the copying machine having such cleaning device, toner and/or powder paper of the transfer paper is attached gradually according to the copying operation on the tip end portion of the blade. This causes the contact or squeeze relation between the blade 2 and the photosensitive layer 1*a* mounted on the photosensitive drum 1 becoming incomplete gradually and the good cleaning becoming impossible, thereby causing the transfer image to be spoiled.

In order to obviate such defects, there has been proposed to select the material of toner and/or blade to prevent toner from being attached on the blade. However, it is difficult to select suitably the material of toner and/or blade and the above problems have not yet been solved perfectly.

Other attempt has been made to solve the above problems. In this attempt, the blade is vibrated in a direction substantially normal to the rotary direction of the photosensitive drum to shake off the attached toner or powder paper from the blade. In this attempt, however, it is impossible to shake off perfectly the attached toner or powder paper from the blade and is necessary to provide further a device for vibrating the blade, resulting in the apparatus becoming complex and expensive.

SUMMARY OF THE INVENTION

One object of the present invention is to provide an electrostatic recording apparatus having a cleaning device which can scrape perfectly toner attached on a blade and solve the above mentioned problems.

The above object can be attained by an electrostatic recording apparatus comprising a cleaning device having a toner scraping member (same as blade) which is movable between a position at which the tip end of the toner scraping member is in contact with an image forming member and a position at which the tip end of the toner scraping member is apart from the image forming member and having a cleaning member arranged on the moving path of the tip end for the toner scraping member.

Other objects and advantages of the present invention will become apparent from the following description in conjunction with the accompanying drawings.

DETAILED DESCRIPTION OF THE PREFERRED EMBODIMENT

Figure 1:
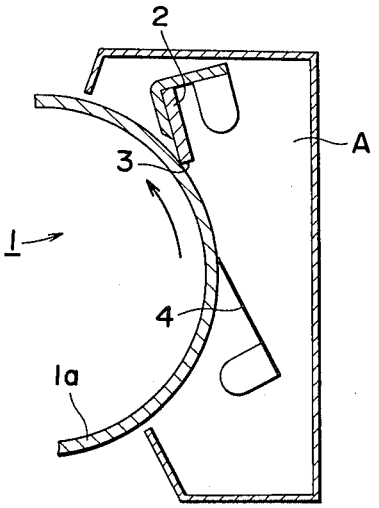
FIG. 1 is a cross-sectional view of the conventional cleaning device.
Figure 2:
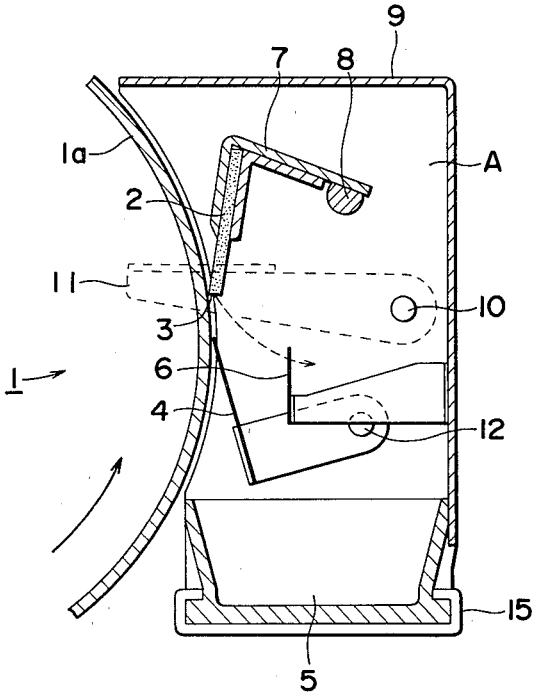
FIG. 2 is a cross-sectional view of a cleaning device of the present invention in the state of use.
Figure 3:
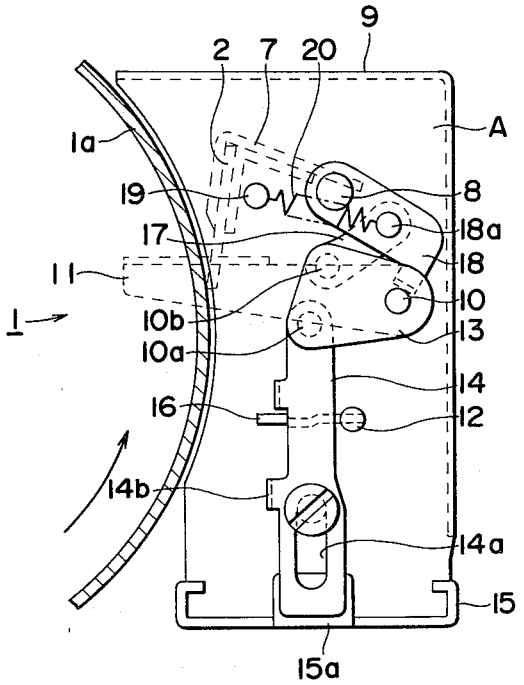
FIG. 3 shows an arrangement of mechanical parts of the cleaning device of the present invention in the state of use.
Figure 4:
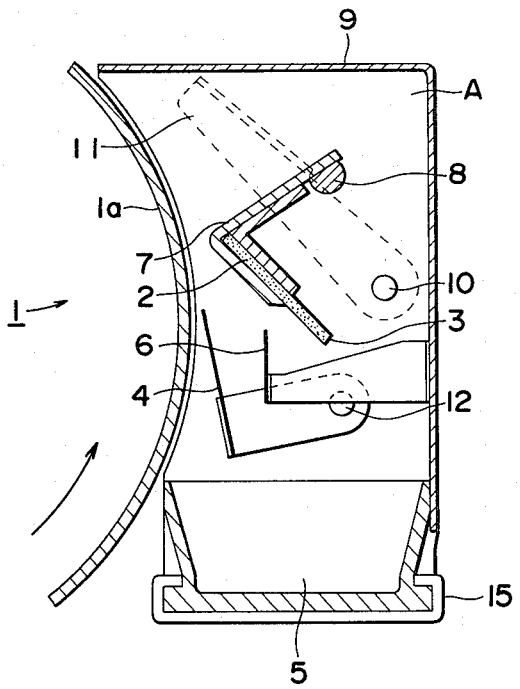
FIG. 4 is a cross-sectional view of the cleaning device of the present invention in the state of toner cleaning.
Figure 5:
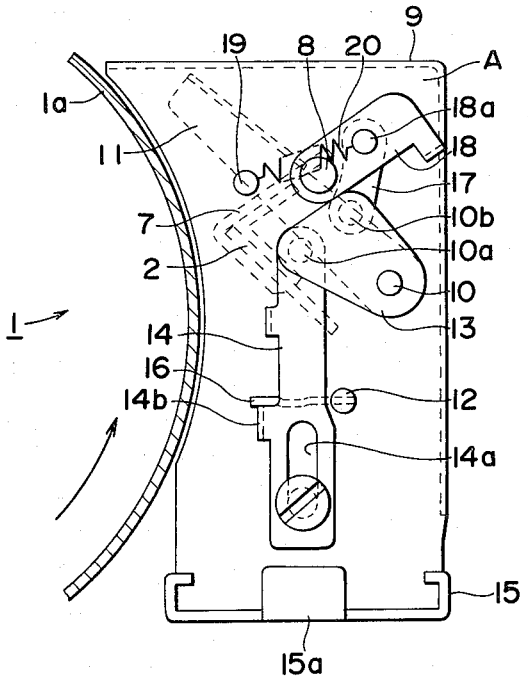
FIG. 5 shows the arrangement of mechanical parts of the cleaning device of the present invention in the state of toner cleaning.

In FIG. 2, a drum 1 having a photosensitive layer 1*a* thereon is rotated in the counter-clockwise direction. Reference numeral 2 designates a cleaning blade made of resilient synthetic rubber and which is elongated along width direction of the drum 1 with length corresponding to about that of latter. A tip end corner portion 3 of the cleaning blade 2 is in contact with on the photosensitive layer 1*a* under a constant pressure for scraping toner. 4 is a toner guide member made of a thin resin plate which is in contact lightly with the photosensitive layer 1*a* and guides scraped toner into a toner receiving box 5. The toner receiving box 5 is mounted to a case 9 by hinge so as to be received when it is desired that the collected toner is thrown. And the box 5 has a base portion (no reference symbol) to be served for maintaining the cleaning device A, fixedly to machine body. 6 is a newly suggested cleaning member made of a resin plate of about 0.1 mm in thickness for scraping off the toner and/or powder paper attached on the tip end corner 3 of the blade 2 and which is fixed in a cleaning device A through a support (no reference symbol). It goes without saying that the member may be made of a rigid plate. The cleaning blade 2 is supported by a supporting member 7 which is rotated about a shaft 8 being mounted on the case 9, directly or through other members. The cleaning blade 2 and the cleaning member 6 are so constructed that when the blade 2 is rotated to counter-clockwise direction as a fulcrum the shaft 8, the tip end portion 3 of the blade 2 is moved along a locus shown by a dotted line and on the way contacted with the cleaning member 6, there and back. When the cleaning operation is continued for a long time of period in the state as shown in FIG. 2, toner and/or powder paper of the transfer paper is attached gradually on the tip end corner portion 3 of the cleaning blade 2, thereby causing the contact or squeeze relation between the blade 2 and the photosensitive layer 1*a* becoming incomplete and good cleaning becoming impossible. In such state, if a lever 11 mounted on the outer back side portion of the cleaning device is rotated in the clockwise direction centering around a shaft 10, the cleaning blade 2 is rotated in the counter-clockwise direction centering around the shaft 8 as shown in FIG. 4. When the cleaning blade 2 is rotated the tip end portion 3 of the blade 2 is contacted with a cleaning member 6 and the toner is removed. FIG. 3 shows a state of the cleaning mechanism portion mounted on the outer front side portion of the cleaning device shown in FIG. 2. FIG. 5 shows a state of the cleaning mechanism portion mounted on the outer front side portion of the cleaning device shown in FIG. 4. The operation of the mechanism portion when the lever 11 shown in FIG. 2 is rotated in the clockwise direction will be explained hereunder, in conjunction with FIGS. 3 and 5. Reference numeral 12 is a shaft for rotary supporting the guide member 4. The shafts 8, 10 and 12 are mounted passing through the cleaning device and appear at the mechanical portion. The rotation in the clockwise direction of the lever 11 causes a plate member 13 to be rotated in the clockwise direction, so that small rotary shafts 10*a* and 10*b* on the plate member 13 are moved from a position shown in FIG. 3 to a position shown in FIG. 5 and that a plate member 14 engaged with the shaft 10*a* and an intermediate plate member 17 engaged with the shaft 10*b* are moved upwardly. The upward movement of the plate member 14 is guided along a longitudinal slot 14*a* formed on the lower part of the member 14. Moving range of the plate member 14 is defined by a stud (no reference symbol) with a head and which is mounted on the outerfront side portion of the device A or case 9 through the slot. The plate member 14 is thus separated from a rising portion 15*a* of a guide rail 15 which is fixed on the electrostatic recording apparatus as shown in FIG. 5. That is to say that the rising portion 15*a* of the guide rail 15 is positioned between the plate member 14 and the outerfront side portion of the cleaning device, as far as the cleaning operation being carried out, for maintaining the device A at a predetermined portion. Further, when the plate member 14 moves upwards a lever 16 is moved upwards by a projecting portion 14*b* of the plate member 14 and rotated in the clockwise direction about the shaft 12, and the toner guide member 4 is separated from the surface of the drum 1, thereby the cleaning device becomes removable from the electrostatic recording apparatus by pulling out from the latter.

When the plate member 17 is moved upwards a plate member 18 is rotated in the counter-clockwise direction from a position shown in FIG. 3 to a position shown in FIG. 5. A tension spring 20 is provided between a first spring engaging metal member 19 on the cleaning device and a second spring engaging metal member 18*a* on the plate member 18. As the plate member 18 rotates centering around the shaft 8, the tension spring 20 makes a tumbler action, so that the plate member 18 is urged to rotate in the clockwise direction and the cleaning blade 2 connected to the plate member 18 is contacted under pressure with the photosensitive layer 1*a* in the state shown in FIG. 3. However, the tension spring 20 acts on the plate member 18 to rotate it in the counter-clockwise direction in the state shown in FIG. 5. Accordingly, the tip end corner portion 3 of the cleaning blade 2 is moved to a position shown in FIG. 4 while it is contacting with the cleaning member 6 as a manner of strike and the toner attached on the tip end corner portion 3 is removed. The toner cleaning action is also produced effectively when the lever 11 is rotated in the counter-clockwise direction from a position shown in FIG. 4 to a position shown in FIG. 2.

As stated above, in the embodiment of the present invention, following two operations are performed by operating the lever 11 mounted at the outside of the cleaning mechanism. In one operation, the toner scraping member (same as cleaning blade mentioned above) is rotated so as to separate it from the photosensitive layer 1*a* and to contact with the stational cleaning member 6, so that the toner attached to the tip end portion 3 of the blade 2 can be removed. In the other operation, the lock of the cleaning device is unlocked and the toner guide member 4 is separated from the photosensitive layer 1*a*, so that the cleaning device can be removed from the electrostatic recording apparatus along a guide member.

In the above embodiment of the present invention, the cleaning member 6 is fixed in the cleaning device. However, it may be possible to provide movably the cleaning member 6 in the cleaning device and to remove toner attached to the tip end of the blade.

What is claimed is:

1. An electrostatic recording apparatus comprising a cleaning device having a movable lever 11 pivotally supported at one end thereof through a shaft 10 on a housing, a plate member 13 which is moved with the lever 11 around the shaft 10, a plate member 14 connected at one end thereof through a shaft 10*a* with a first portion of the plate member 13, an intermediate plate member 17 pivotally connected at one end thereof through a shaft 10*b* with a second portion of the plate member 13, a plate member 18 pivotally supported at one end thereof through a shaft 8 by the housing 9, a shaft 18*a* for connecting the other end of the intermediate plate member 17 with the plate member 18, a tension spring 20, one end of which is fixed to the housing 9 and the other end of which is fixed to the shaft 18*a*, a toner scraping member 2 including a tip end 3 which is movable along a path between a position where the tip end 3 of the toner scraping member 2 is in contact with an image forming member 1*a* and a position where the tip end 3 of the toner scraping member 2 is apart from the image forming member 1*a* and fixed to the plate member 18, and a cleaning member 6 arranged on the path of the tip end 3 for the toner scraping member 2, the cleaning member 6 being operable to scrape off residual toner attached to the tip end 3 of the toner scraping member 2 when the tip end 3 moves along the path past the cleaning member 6.

2. An electrostatic recording apparatus according to claim 1, wherein the cleaning device further comprises a toner guide member 4 pivotally supported through a shaft 12 on the housing so that it is in contact with the image forming member, and a projecting portion 14*b* provided on the plate member 14 for moving the toner guide member 4 when the plate member 14 is moved so that the toner guide member 4 is apart from the image forming member.

3. An electrostatic recording apparatus according to claim 1 or 2 wherein the cleaning member can be removed from the machine frame of the electrostatic recording apparatus.

4. An electrostatic recording apparatus according to claim 1 or 2, wherein the cleaning member 6 is movable in the housing.

* * * * *